US006454380B1

(12) United States Patent
Endo

(10) Patent No.: US 6,454,380 B1
(45) Date of Patent: Sep. 24, 2002

(54) DOT DROPOUT INSPECTION METHOD AND PRINTER, AND RECORDING MEDIUM STORING PROGRAM THEREFORE

(75) Inventor: Hironori Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 7 days.

(21) Appl. No.: 09/645,509

(22) Filed: Aug. 25, 2000

Related U.S. Application Data

(63) Continuation of application No. PCT/JP99/07385, filed on Dec. 27, 1999.

(30) Foreign Application Priority Data

Dec. 25, 1998 (JP) ..... 10-368686

(51) Int. Cl.[7] ..... B41J 2/01
(52) U.S. Cl. ..... 347/19
(58) Field of Search ..... 347/15, 19, 43; 400/74

(56) References Cited

U.S. PATENT DOCUMENTS 5,796,414 A * 8/1998 Sievert et al. ..... 347/19
5,850,237 A 12/1998 Slade ..... 347/23
6,260,938 B1 * 7/2001 Ohtsuka et al. ..... 347/15

FOREIGN PATENT DOCUMENTS

JP 6-79956 3/1994
JP 6-320729 11/1994
JP 8-25764 1/1996
JP 8-187881 7/1996
JP 10-34976 2/1998
JP 10-119309 5/1998
JP 10-217471 8/1998
JP 11-48463 2/1999
JP 11-188853 7/1999

* cited by examiner

*Primary Examiner*—Craig A. Hallacher
(74) *Attorney, Agent, or Firm*—Oblon, Spivak, McClelland, Maier & Neustadt, P.C.

(57) ABSTRACT

A system for inspecting nozzles jetting ink droplets for detecting clogging of nozzles in a printer. Different timings during different printing operations for conducting the inspection are preset with respect to at least two print modes among a plurality of print modes usable in the printer. Alternatively, different combinations of timings for conducting the inspection and inspection principles are preset with respect to at least two print modes among the plurality of print modes. When printing is performed according to a print mode selected from among the at least two print modes, the printer conducts the inspection at the timing and/or the inspection principle preset with respect to the selected print mode.

18 Claims, 9 Drawing Sheets

INSPECTION TIMING AND INSPECTION METHOD BY PRINT MODE

APPLICATION EXAMPLE 2

| MODE ID | MODE NAME | DOT DROPOUT INSPECTION TIMING | INSPECTION METHOD UTILIZED | | |
|---|---|---|---|---|---|
| | | | FLYING DROPLET | DIAPHRAGM | PATCH |
| M1a | FIRST DRAFT (360dpi, s=1 pass) | NO INSPECTION | × | × | × |
| M1b | DRAFT (360dpi, s=1 pass) | BEFORE PRINTING EACH PAGE | ◎ | △ | × |
| M2 | FINE (720dpi, s=2 passes) | EVERY PASS | ◎ | △ | × |
| M3 | SUPER-FINE (720dpi, s=4 passes) | BEFORE PRINTING EACH PAGE | △ | △ | ◎ |
| | | EVERY PASS | ◎ | △ | × |

FLYING DROPLET INSPECTION METHOD (FIRST)

FLYING DROPLET INSPECTION METHOD (SECOND)

VIBRATING DIAPHRAGM INSPECTION METHOD

COLOR PATCH INSPECTION METHOD

*Fig.7(A)*

INSPECTION TIMING AND INSPECTION METHOD BY PRINT MODE
APPLICATION EXAMPLE 1

| MODE ID | MODE NAME | DOT DROPOUT INSPECTION TIMING | INSPECTION METHOD UTILIZED | | |
|---|---|---|---|---|---|
| | | | FLYING DROPLET | DIAPHRAGM | PATCH |
| M1 | DRAFT (360dpi, s=1 pass) | BEFORE PRINTING EACH PAGE | ◎ | △ | × |
| M2 | FINE (720dpi, s=2 passes) | EVERY PASS | ◎ | △ | × |
| M3 | SUPER-FINE (720dpi, s=4 passes) | BEFORE PRINTING EACH PAGE | △ | △ | ◎ |

*Fig.7(B)*

INSPECTION TIMING AND INSPECTION METHOD BY PRINT MODE
APPLICATION EXAMPLE 2

| MODE ID | MODE NAME | DOT DROPOUT INSPECTION TIMING | INSPECTION METHOD UTILIZED | | |
|---|---|---|---|---|---|
| | | | FLYING DROPLET | DIAPHRAGM | PATCH |
| M1a | FIRST DRAFT (360dpi, s=1 pass) | NO INSPECTION | × | × | × |
| M1b | DRAFT (360dpi, s=1 pass) | BEFORE PRINTING EACH PAGE | ◎ | △ | × |
| M2 | FINE (720dpi, s=2 passes) | EVERY PASS | ◎ | △ | × |
| M3 | SUPER-FINE (720dpi, s=4 passes) | BEFORE PRINTING EACH PAGE | △ | △ | ◎ |
| | | EVERY PASS | ◎ | △ | × |

DRAFT MODE M1 (360dpi, s=1)

FINE MODE M2 (720dpi, s=2)

SUPER-FINE MODE M2 (720dpi, s=4)

DOT DROPOUT INSPECTION METHOD AND PRINTER, AND RECORDING MEDIUM STORING PROGRAM THEREFORE

CROSS-REFERENCE TO RELATED DOCUMENTS

This document is a continuation of and claims priority on PCT/JP99/07385 filed Dec. 27, 1999 the entire contents of which are hereby incorporated herein by reference. This document is also related to and claims priority on Japanese Patent Application No. 10-368,680, the entire contents of which are hereby incorporated herein by reference.

BACKGROUND OF THE INVENTION

1. Field of the Invention

The present invention relates to a technology for printing images by jetting ink droplets from each of a plurality of nozzles to record dots on the surface of a printing medium, and particularly to a technology for inspecting whether or not ink droplets are jetted from the individual nozzles.

2. Discussion of the Background

An inkjet printer prints images by jetting ink droplets from a plurality of nozzles. The print head of an ink jet printer is equipped with a large number of nozzles. Due to an increase in ink viscosity and/or bubble entrainment and the like, some of the nozzles may clog and become incapable of jetting ink droplets. Nozzle clogging degrades image quality by causing dot dropout within the image.

The background way of inspecting for nozzle clogging is for the user to print a special test pattern on printing paper before starting the printing operation and to then examine the printed test pattern visually.

Most printers have a plurality of printing modes, including a high-image-quality print mode for achieving high image quality at a relatively high printing resolution and a high-speed print mode for achieving high-speed printing at a relatively low printing resolution. The importance of inspecting for dot dropout may vary with the print mode. In the high-image-quality print mode, for instance, inspection for dot dropout is important because the presence/absence of dot dropout markedly affects image quality. In the high-speed print mode, on the other hand, inspection for dot dropout is not so important because greater priority is given to speed than image quality.

Conventionally, the printer has conducted dot dropout inspection before the printing operation in response to an instruction from the user when the user thinks it necessary. Therefore, when nozzles have clogged and no dot dropout inspection is carried out before printing in the high-image-quality print mode, dot dropout may occur and make it impossible to obtain the desired image quality.

SUMMARY OF THE INVENTION

One object of the present invention is to provide novel technology enabling dot dropout inspection to be reliably effected when required.

A further object of the present invention is to overcome the above-noted problems of the background art.

In order to attain at least part of the above objects, in a first configuration of the present invention, different timings during a printing operation are preset, as timings for conducting an inspection for the presence/absence of jetting of ink droplets from nozzles, with respect to at least two print modes among a plurality of print modes. The plurality of print modes differ in at least one of print resolution and raster line recording speed indicative of the net time required to record one raster line. When printing is performed according to a print mode selected from among the at least two print modes, the inspection is conducted at the timing preset with respect to the selected print mode.

The need for dot dropout inspection differs according to print mode. Therefore, if the inspection is conducted at a timing matched to the print mode, reliable dot dropout inspection can be conducted as necessary.

In a second configuration of the present invention, different combinations of timings for conducting an inspection for the presence/absence of jetting of ink droplets from the nozzles and an inspection principle are preset with respect to at least two print modes among a plurality of print modes. The plurality of print modes differ in at least one of print resolution and raster line recording speed indicative of the net time required to record one raster line. When printing is performed according to a print mode selected from among the at least two print modes, the inspection is conducted in accordance with the timing and inspection principle preset with respect to the selected print mode.

Such an operation makes it possible to set a preferable combination of dot dropout inspection timing and inspection principle matched to the print mode, and thereby reliable dot dropout inspection can be conducted as necessary.

The printing may be performed without conducting the inspection in the print mode whose raster line recording speed and print resolution are lowest among all print modes usable by the printer. Since the necessity of dot dropout inspection is low in such a print mode, higher speed printing can be performed by not conducting dot dropout inspection.

Further, only nozzles actually used in the printing operation may be selected for targets of the inspection. This enables the inspection time to be shortened.

The present invention can be implemented in various modes including, for example, a dot drop inspection method and device, a computer program for realizing the functions of the method or device, a recording medium recorded with the computer program, and data signals including the computer program embodied in a carrier wave.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIGS. 7(A) and 7(B) are explanatory diagrams showing a plurality of print modes usable by the printer, the dot dropout inspection timing by print mode, and the inspection method used;

DESCRIPTION OF THE PREFERRED EMBODIMENTS

Figure 1:
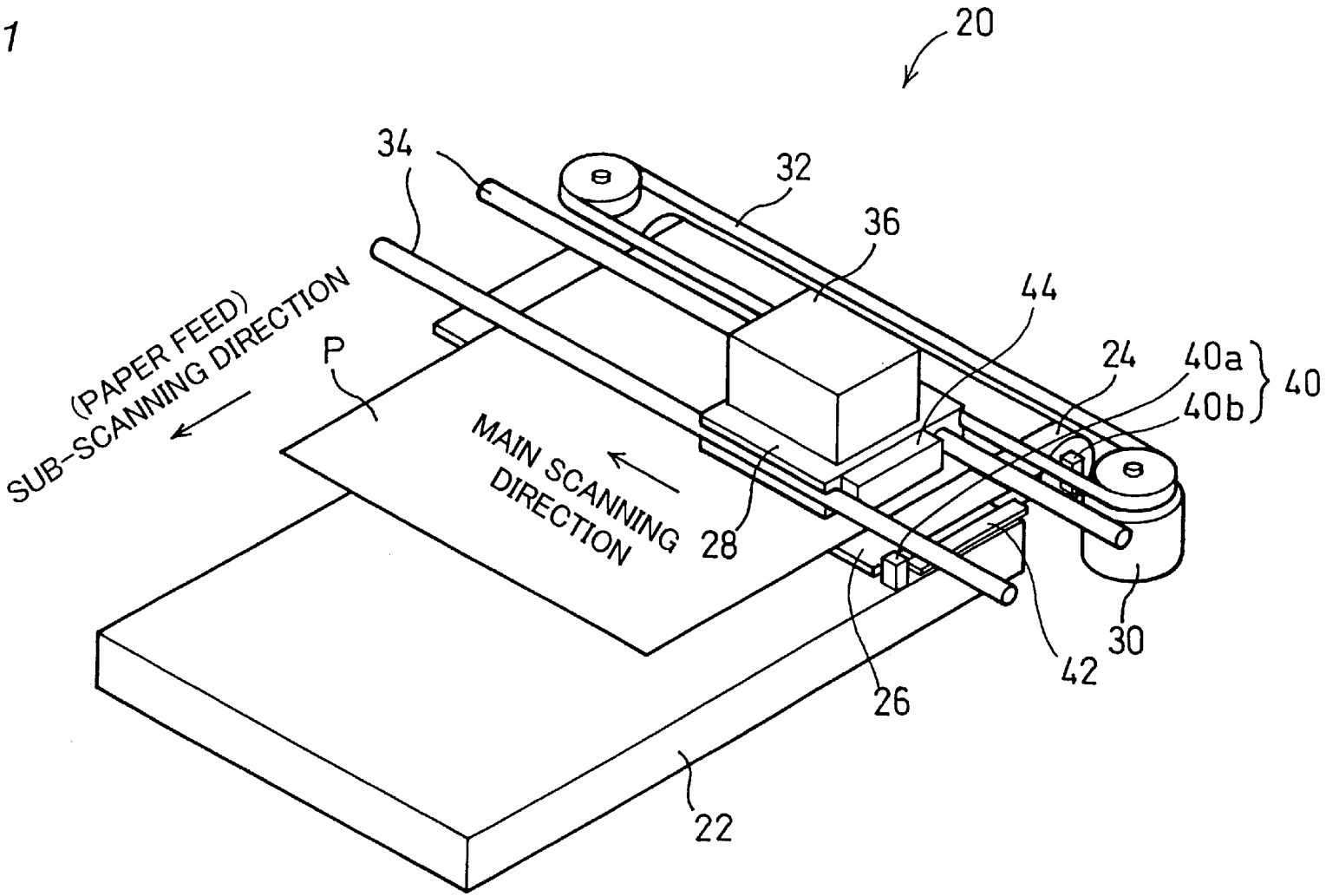
FIG. 1 is a schematic perspective view showing the main structure of a color inkjet printer embodying the present invention.

Referring now to the drawings, wherein like reference numerals designate identical or corresponding parts throughout the several views, the details of embodiments of the present invention are now described.

Modes of implementing the present invention are now explained with reference to the following embodiments. FIG. 1 is a schematic perspective view showing the main structure of a color inkjet printer 20 embodying the present invention. The printer 20 is equipped with a sheet stacker 22, a paper feed roller 24 driven by a step motor (not shown), a platen plate 26, a carriage 28, a further step motor 30, a traction belt 32 driven by the step motor 30, and guide rails 34 for the carriage 28. A print head 36 equipped with a large number of nozzles is mounted on the carriage 28.

A first dot dropout inspection unit 40 and a second dot dropout inspection unit 42 are provided at a prescribed standby position (home position) of the carriage 28 and a third dot dropout inspection unit 44 is provided on a side face of the carriage 28. The first dot dropout inspection unit 40 is equipped with a light-emitting element 40*a* and a light-receiving element 40*b*. Dot dropout inspection is conducted by using the elements 40*a* and 40*b* to check the flying state of ink droplets, The second dot dropout inspection unit 42 inspects for dot dropout by checking whether or not a diaphragm provided at its upper surface is being vibrated by ink droplets. The third dot dropout inspection unit 44 inspects for dot dropout by optically reading a prescribed inspection pattern printed on a sheet of printing paper P. The inspections conducted by the respective dot dropout inspection units are explained in detail below.

The paper feed roller 24 takes up the printing paper sheet P from the sheet stacker 22 and feeds the paper sheet P over the surface of the platen plate 26 in the sub-scanning direction. The carriage 28 is drawn by the traction belt 32 driven by the step motor 30 so as to move along the guide rails 34 in the main scanning direction. The main scanning direction is perpendicular to the sub-scanning direction.

Figure 2:
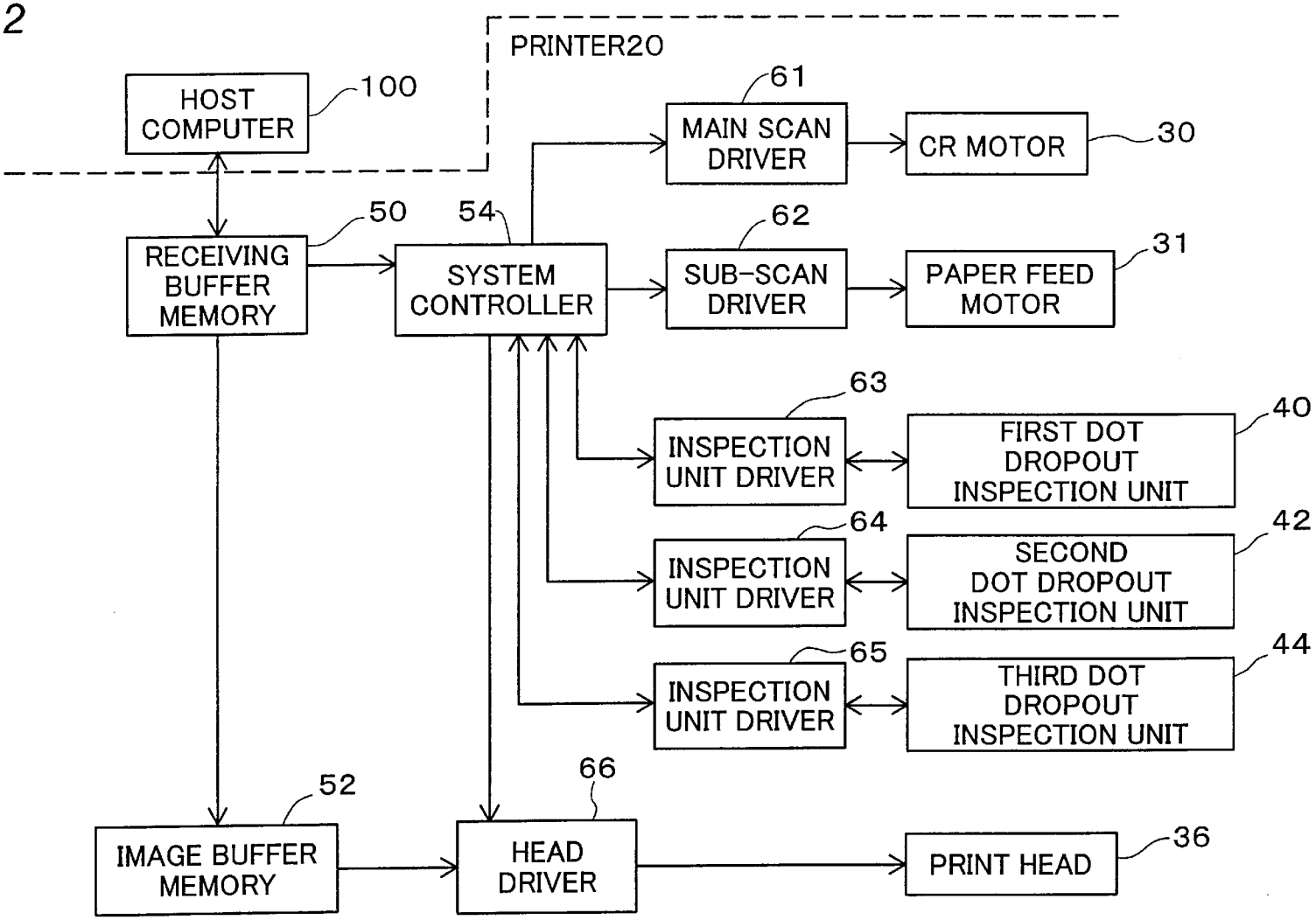
FIG. 2 is a block diagram showing the electrical configuration of the printer of FIG. 1.

FIG. 2 is a block diagram showing the electrical configuration of the printer 20. The printer 20 is equipped with a receiving buffer memory 50 for receiving signals supplied from a host computer 100, an image buffer memory 52 for storing print data, and a system controller 54 for controlling the overall operation of the printer 20. Connected to the system controller 54 are a main scan driver 61 for driving the step motor 30, a sub-scan driver 62 for driving the paper feed motor 31, inspection unit drivers 63, 64, and 65 for driving the three dot dropout inspection units 40, 42, and 44, and a head driver 66 for driving the print head 36.

A printer driver (not shown) of the host computer 100 is responsive to the print mode selected by the user for determining various parameter values that regulate the printing operation. Based on the determined parameter values, the printer driver generates print data for printing in the selected print mode and transfers the generated data to the printer 20. The transferred print data are initially stored in the receiving buffer memory 50. Inside the printer 20, the system controller 54 reads required information from the print data stored in the receiving buffer memory 50 and sends control signals based thereon to the drivers 61–66.

The print data received by the receiving buffer memory 50 are separated into color components, and the image data for the respective color components are stored in the image buffer memory 52. The head driver 66 reads each color component of the image data from the image buffer memory 52 in response to control signals from the system controller 54 and drives a multi-color nozzle array provided on the print head 36 in accordance with the read data.

Figure 3:
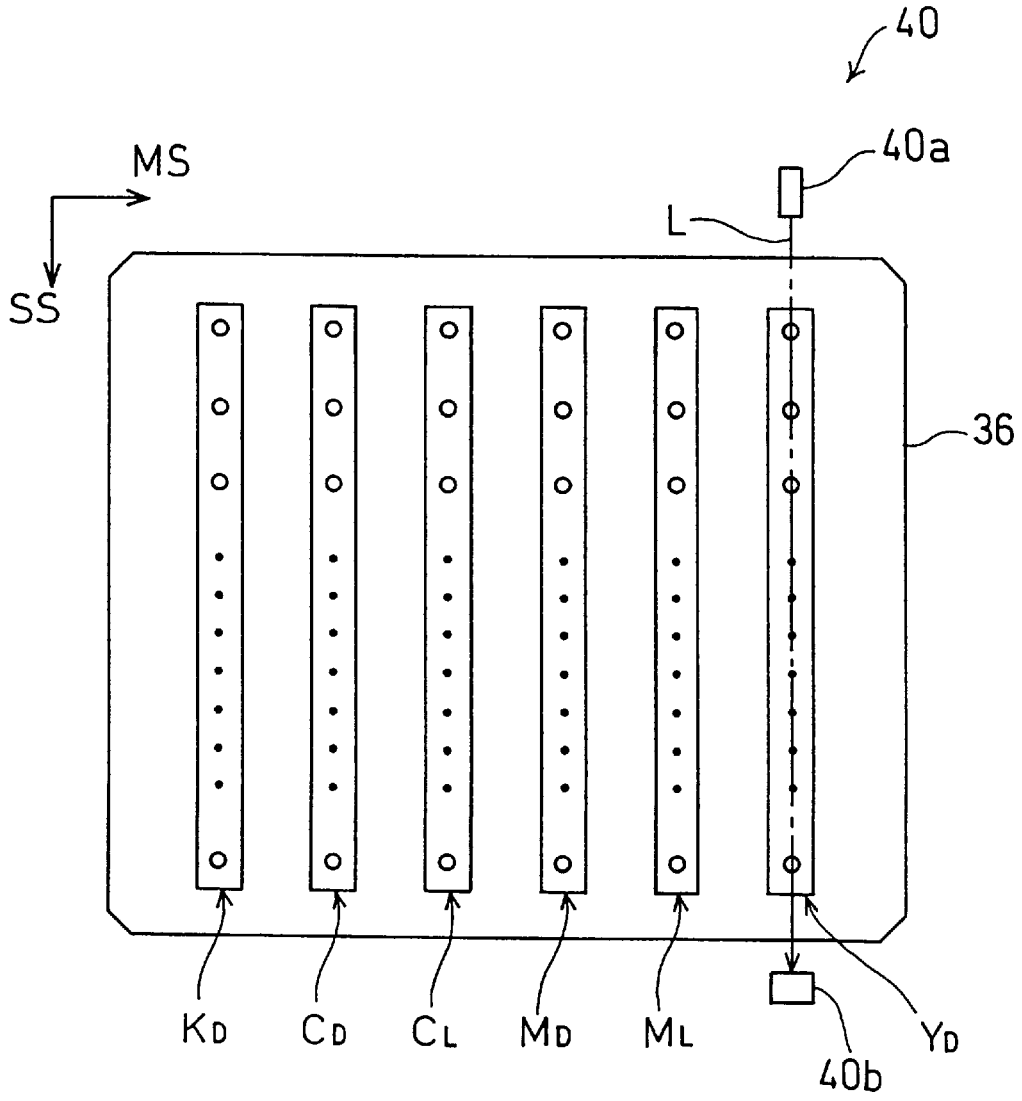
FIG. 3 is an explanatory diagram illustrating the structure of a first dot dropout inspection unit and the principle of its inspection method, referred to as the flying droplet inspection method.

FIG. 3 is an explanatory diagram illustrating the structure of the first dot dropout inspection unit 40 and the principle of its inspection method, referred to as the flying droplet inspection method. FIG. 3 is a view of the underside of the print head 36, showing a six color nozzle array of the print head 36 and the light-emitting element 40*a* and light-receiving element 40*b* constituting the first dot dropout inspection unit 40.

The undersurface of the print head 36 is provided with a black ink nozzle group $K_D$ for jetting black ink, a dark cyan ink nozzle group $C_D$ for jetting dark cyan ink, a light cyan ink nozzle group $C_L$ for jetting light cyan ink, a dark magenta ink nozzle group $M_D$ for jetting dark magenta ink, a light magenta ink nozzle group $M_L$ for jetting light magenta ink, and a yellow ink nozzle group $Y_D$ for jetting yellow ink.

In the reference symbols of the nozzle groups, the initial upper case character indicates the ink color, the subscript character "$_D$" indicates an ink of relatively high depth of color, and the subscript character "$_L$" indicates an ink of relatively low depth of color. The subscript character "$_D$" of the "yellow ink nozzle group $Y_D$" means that the yellow ink jetted from this nozzle group produces gray color when mixed with approximately equal amounts of dark cyan ink and dark magenta ink. The subscript character of the "black ink nozzle group $K_D$" means that the black ink jetted from this nozzle group is not gray but black of 100% depth of color.

The plurality of nozzles of each nozzle group are aligned in the sub-scan direction SS. During printing, the print head 36 jets ink from the nozzles while moving in the main scan direction MS together with the carriage 28 (FIG. 1).

The light-emitting element 40*a* is a laser that emits a light beam L of an outer diameter not greater than 1 mm. The light beam L is emitted in parallel with the sub-scan direction SS to be received by the light-receiving element 40*b*. During dot dropout inspection, first, as shown in FIG. 3, the print head 36 is positioned so that the nozzles of one color (e.g., the dark yellow $Y_D$ nozzles) are located above the path of the light beam L. In this state, the head driver 66 (FIG. 2) is used to operate the dark yellow $Y_D$ nozzles successively one at a time and each for a prescribed drive period, and thereby those nozzles successively jet an ink droplet from each nozzle. As each jetted ink droplet blocks the path of the light beam L in the course of its flight, the light reception at the light-receiving element 40*b* is momentarily interrupted. Therefore, when an ink droplet is jetted normally from a given nozzle, it can be judged that the nozzle is not clogged from the fact that the light beam L is momentarily blocked from reaching the light-receiving element 40*b*. When the light beam L is not blocked whatsoever during the nozzle drive period, it can be judged that the nozzle is clogged. As reliable detection to determine whether or not the light beam L is blocked may be impossible with only a single ink droplet, several droplets are preferably jetted from each nozzle.

When inspection for clogging has been completed for all nozzles of one color, the print head 36 is moved in the main scanning direction in order to inspect the nozzles of the next color (the light magenta $M_L$ nozzles in the illustrated example).

This flying droplet inspection method inspects each nozzle for the presence/absence of clogging (and thus for the presence/absence of dot dropout) by detecting jetted ink droplets during flight and is therefore advantageous in that the inspection can be completed in a relatively short time.

Figure 4:
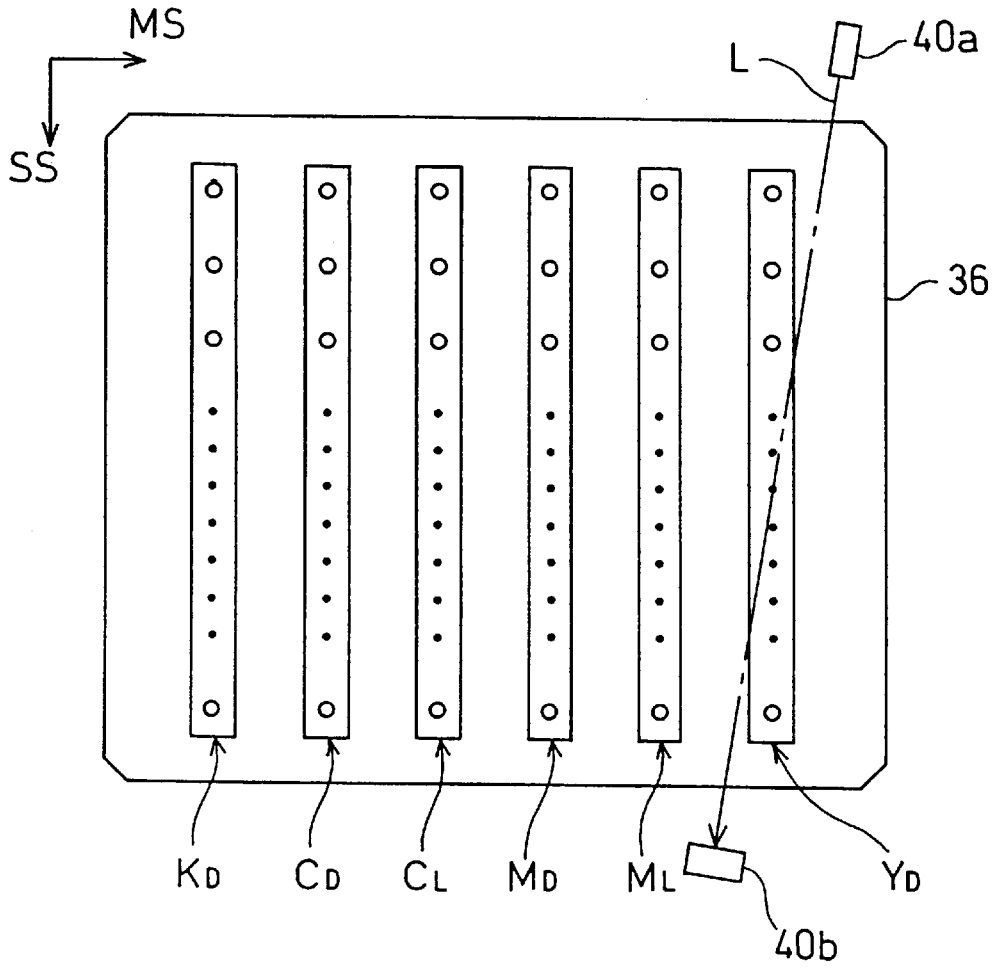
FIG. 4 is an explanatory diagram showing another structure of the first dot dropout inspection unit.

FIG. 4 is an explanatory diagram showing another structure the first dot dropout inspection unit 40 can take. As shown in FIG. 4, the orientations of the light-emitting element 40*a* and light-receiving element 40*b* are adjusted so that the direction of travel of the light beam L is inclined somewhat relative to the sub-scan direction SS. Specifically, the direction of travel of the light beam L is set so that when an ink drop jetted from one nozzle is being detected the light beam L is not blocked by ink droplets jetted from any other nozzle. In other words, it is set so that the path of the light beam L does not interfere with a plurality of paths of ink droplets from a plurality of nozzles.

When the light beam L is emitted in an oblique direction inclined with respect to the sub-scan direction SS in this way, every nozzle can be inspected for clogging by successively operating the nozzles, one by one, to jet ink droplets while slowly moving the print head 36 in the main scanning direction. This method is advantageous in that it enables inspection for clogging even with respect to nozzles whose jetted ink droplets happen to deviate somewhat from the prescribed location or direction.

Figure 5:
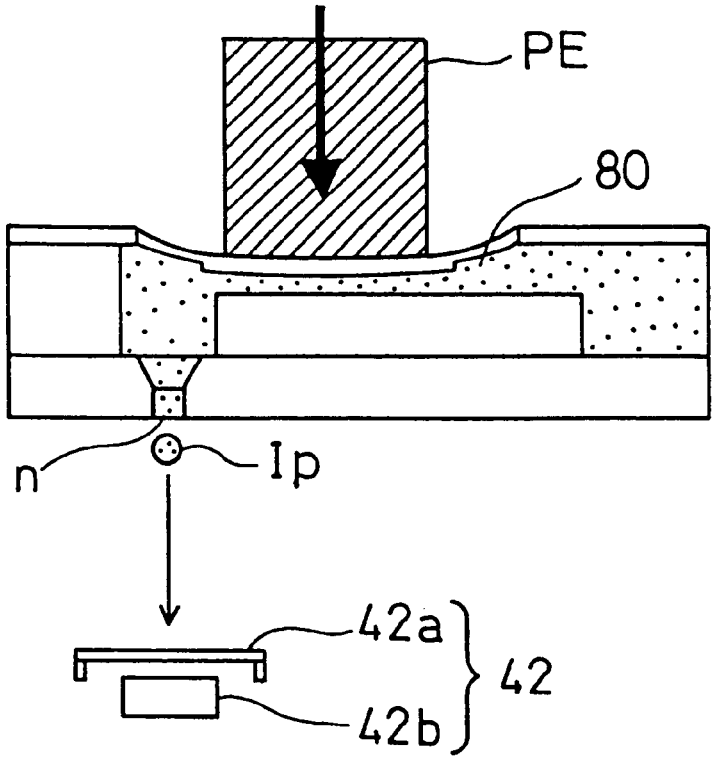
FIG. 5 is an explanatory diagram illustrating the structure of a second dot dropout inspection unit and the principle of its inspection method, referred to as the vibrating diaphragm inspection method.

FIG. 5 is an explanatory diagram illustrating the structure of the second dot dropout inspection unit 42 and the principle of its inspection method, referred to as the vibrating diaphragm inspection method. FIG. 5 is a sectional view taken in the vicinity of one nozzle n of the print head 36 and also shows a diaphragm 42*a* and a microphone 42*b* constituting the second dot dropout inspection unit 42.

A piezoelectric element PE provided in association with each nozzle n is located to be in contact with an ink passage 80 for conducting ink to the nozzle n. When a voltage is applied to the piezoelectric element PE, it elongates to deform one wall of the ink passage 80. The volume of the ink passage 80 is therefore reduced in proportion to the elongation of the piezoelectric element PE, thereby jetting an ink droplet Ip from the tip of the nozzle n at high speed.

When the ink droplet Ip jetted from the nozzle n reaches the diaphragm 42*a*, the diaphragm 42*a* vibrates. The microphone 42*b* converts the vibration of the diaphragm 42*a* into an electric signal. Whether or not an ink droplet Ip reached the diaphragm 42*a* (and thus whether or not the nozzle is clogged) can therefore be ascertained by detecting the output signal from the microphone 42*b*.

Such pairs of diaphragms 42*a* and microphones 42*b* are preferably arranged in the sub-scanning direction in a number equal to the number of nozzles of one color. This enables all nozzles of each color to be simultaneously inspected for the presence/absence of clogging. If ink droplets Ip are simultaneously jetted from adjacent nozzles, however, erroneous detection may occur due to interference between adjacent diaphragms 42*a*. Such erroneous detection is therefore preferably prevented by carrying out simultaneous inspection on sets of nozzles whose members are separated by several intervening nozzles.

Figure 6A:
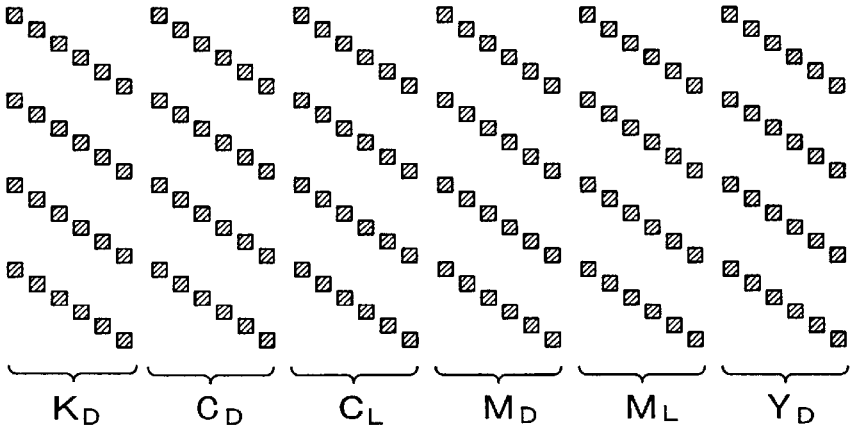
FIGS. 6(A) and 6(B) are explanatory diagrams illustrating the structure of a third dot dropout inspection unit and the principle of its inspection method, referred to as the color patch inspection method.
Figure 6B:
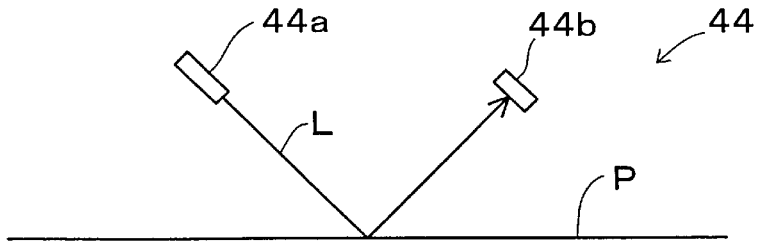

FIGS. 6(A) and 6(B) are explanatory diagrams illustrating the structure of the third dot dropout inspection unit 44 and the principle of its inspection method, referred to as the color patch inspection method. FIG. 6(A) shows color patches printed on printing paper with six color inks. Each color patch is, for example, a square measuring about 2 mm per side and each patch is printed by a single nozzle. The illustrated example assumes that the print head is equipped with 48 nozzles per color and prints 48 color patches per color. The reason for defining the patch size as about 2 mm square is that very small color patches formed by only a few ink droplets from each nozzle are highly likely not to be optically detected with sufficient accuracy.

The color patches (inspection pattern) can be printed on ordinary printing paper P or on a special small test paper fed to the standby position (home position) of the carriage 28 separately from the printing paper.

FIG. 6(B) shows how the third dot dropout inspection unit 44 reads a color patch printed on the printing paper P. The third dot dropout inspection unit 44 is constituted as a photo-reflector equipped with a light-emitting element 44*a* and a light-receiving element 44*b*. The light-emitting element 44*a*, a light-emitting diode for instance, directs an illumination light beam L onto a color patch on the printing paper P. The illumination light beam L is reflected by the color patch and the reflected light is received by the light-receiving element 44*b*. The amount of light received by the light-receiving element 44*b* depends on whether or not a color patch is present at the location illuminated by the illumination light beam L. Whether or not a color patch is present at the location illuminated by the illumination light beam L can therefore be determined by investigating the amount of light received by the light-receiving element 44*b*. Since the nozzle used to form each color patch is known beforehand, discrimination of whether or not the individual nozzles are clogged is therefore possible.

If the color of the illumination light beam L is red, good detection of inks with colors near red (dark magenta $M_D$, light magenta ink $M_L$, yellow ink $Y_D$) may be impossible. It is therefore preferable to ensure detection of inks near red by using, as the illumination light beam L, a blue light beam, a white light beam, or a combination of two illumination light beams of different colors.

Pairs of light-emitting elements 44*a* and light-receiving elements 44*b* are preferably arranged in the sub-scanning direction in a number equal to or greater than the number of color patches of each row in the sub-scanning direction (4 in the example of FIG. 6(A)). In particular, if a number of pairs of light-emitting elements 44*a* and light-receiving elements 44*b* equal to the number of nozzles of each color are provided in the same arrangement as that of the color patches, all nozzles of each color can be simultaneously inspected for the presence/absence of clogging.

Although the color patch inspection method needs time for printing the color patches, and therefore requires a longer inspection period than either the flying droplet inspection method or the vibrating diaphragm inspection method, it is advantageous in that the reliability of the inspection for nozzle clogging is higher.

FIGS. 7(A) and 7(B) are explanatory diagrams showing a plurality of print modes usable by the printer 20, the dot dropout inspection timing for each print mode, and the inspection method used. In Application Example 1 shown in FIG. 7(A), the printer 20 is assumed to be capable of using three print modes: draft (high speed, low image quality) mode M1, fine (medium speed, high image quality) mode M2, and super-fine (low speed, very high image quality) mode M2. Draft mode M1 has a print resolution of 360 dpi and a scan repetition number s (explained below) of 1. The fine mode M2 has a print resolution of 720 dpi and a scan repetition number s of 2. The super-fine mode M3 has a print resolution of 720 dpi and a scan repetition number s of 4.

Figure 8A:
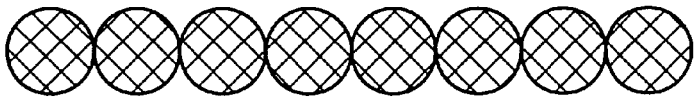
FIGS. 8(A)–8(C) are explanatory diagrams illustrating how individual pixels are recorded on a single raster line in three print modes.
Figure 8B:
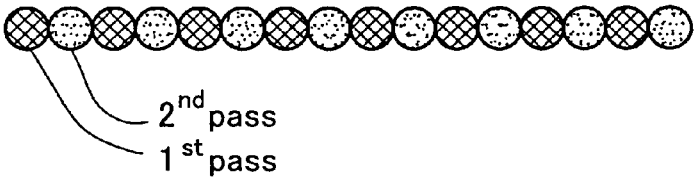
Figure 8C:
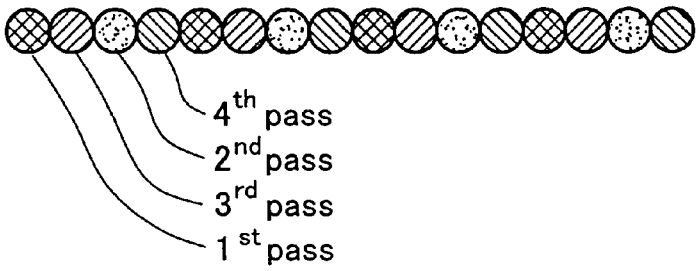

FIGS. 8(A)–8(C) illustrate how individual pixels are recorded on a single raster line (main scanning line) in the three print modes M1–M3. The "scan repetition number s" means the number of main scans executed to record all pixels on a single raster line. Thus, as shown in FIG. 8(A), in draft mode M1, which has a scan repetition number s of 1, all pixels on a single raster line are recorded in a single main scan. As shown in FIG. 8(B), in fine mode M2, which has a scan repetition number s of 2, the pixels of a single raster line are recorded in two main scans (in this specification, one main scan during printing operation is called a "pass"). In the case of bi-directional printing, a single scan in the forward direction is one pass and a single scan in the reverse direction is also one pass. In FIG. 8(B), the dots filled in with hatching indicate the locations of pixels to be recorded in the first pass and the dots filled in with a sand-like pattern indicate the locations of pixels to be recorded in the second pass. As shown in FIG. 8(C), in the super-fine mode M3, which has a scan repetition number s of 4, the pixels of a single raster line are recorded in four main scans.

Super-fine mode M3 can achieve higher image quality than fine mode M2 because it reduces the image-degrading effect of errors in the impact points of the ink droplets produced by the nozzles. The ink droplet impact point on the printing paper sometimes differs slightly among different nozzles. When a raster line is recorded with a single nozzle, therefore, any error in the impact point of the ink droplets produced by the nozzle will be directly reproduced as an error in the position of the raster line. When a raster line is recorded with many nozzles, on the other hand, the effect of an ink droplet impact point error becomes less noticeable because the errors of the different nozzles average out. The effect of image quality degradation due to nozzle impact point error can therefore be decreased in proportion as the number of nozzles used to record a single raster line is increased. Since the super-fine mode M3 records each raster line with four nozzles, it improves image quality in comparison with the fine mode M2 that records each raster line with two nozzles.

The recording of each raster line is completed in s number of main scans. If N number of nozzles are used for each color, therefore, the net number of raster lines whose recording is completed by one main scan is N/s. Since it can be considered that one main scan in effect conducts printing using N/s number of nozzles per color, the value N/s can be called the "effective nozzle number." The effective nozzle number N/s can be thought of as a value indicating the net time period needed to record each raster line. The effective nozzle number N/s is therefore proportional to the raster line recording speed and, for the same print resolution, is proportional to the printing speed.

As shown in FIG. 7(A), in draft mode M1, dot dropout inspection is conducted before printing every page. In other words, when printing a plurality of pages, dot dropout inspection is conducted prior to printing each succeeding page. The flying droplet inspection method (FIGS. 3 and 4) is used as the inspection method. In the tables of FIG. 7, ◎ indicates the preferable inspection method, Δ indicates a usable inspection method, and x indicates an ordinarily unusable inspection method. The flying droplet inspection method is suitable for the draft mode M1 because the inspection period is shorter than those of the other inspection methods. The vibrating diaphragm inspection method (FIG. 5) can be used instead of the flying droplet inspection method. The reason for using the flying droplet inspection method or the vibrating diaphragm inspection method in the draft mode M1 is that an inspection method with the shortest possible inspection period is desired because in the draft mode M1 printing speed takes precedence over image quality.

In the fine mode M2, dot dropout inspection is conducted every pass. "Pass" means main scan. In other words, in fine mode M2 dot dropout inspection is conducted every time a scan is conducted. More specifically, inspection is timed in advance to be executed either before conducting each pass or after conducting each pass. The method of inspecting before conducting each pass and the method of inspecting after conducting each pass differ only in whether inspection is conducted at the start or end of printing each page and both are conducted at the same timing in the course of printing each page. The flying droplet inspection method (FIGS. 3 and 4) can be used as the inspection method, but it is also possible to use the vibrating diaphragm inspection method instead of the flying droplet inspection method. The reason for using the flying droplet inspection method or the vibrating diaphragm inspection method is to reduce the time required for the overall printing operation by utilizing an inspection method of the shortest inspection period possible, because a large number of passes are conducted to print one page.

In the super-fine mode M3, dot dropout inspection is conducted by the color patch inspection method before printing each page. The color patch inspection method is utilized because it enables more reliable inspection. Since image quality takes precedence over printing speed in the super-fine mode M3, it is preferable to utilize the color patch inspection method enabling more reliable inspection, even though the inspection period is relatively long.

FIG. 7(B) shows another application, i.e. Application Example 2, of the print mode and inspection method. Application Example 2 differs from Application Example 1 in the following two points. The first difference is that the draft mode M1 in Application Example 1 is divided into a first draft mode M1*a* and an ordinary draft mode M1*b* in Application Example 2. The first draft mode M1*a* is the same as the ordinary draft mode M1*b* in print resolution and scan repetition number s but differs in the point that it does not conduct dot dropout inspection. This enables printing to be completed faster because time spent for dot dropout inspection can be saved. With regard to the one print mode that, among the plurality of print modes usable by the printer, is lowest in both printing speed and print resolution, it is in this way possible to perform printing without carrying out dot dropout inspection. It is also noted that in Application Example 2 the ordinary draft mode M1*b* can be omitted and only the first draft mode M1*a* may be made usable. The second difference is that in the super-fine mode M3 of Application Example 2, not only is dot dropout inspection conducted before printing each page but dot dropout inspection is also conducted at every pass. This is advantageous in that it enables nozzle clogging to be detected immediately even when the clogging occurs in the course of printing a page.

When dot dropout (nozzle clogging) is detected in any of the print modes, various prescribed measures are implemented. For example, nozzle cleaning, termination of the printing operation, and other such measures can be taken.

Figure 9:
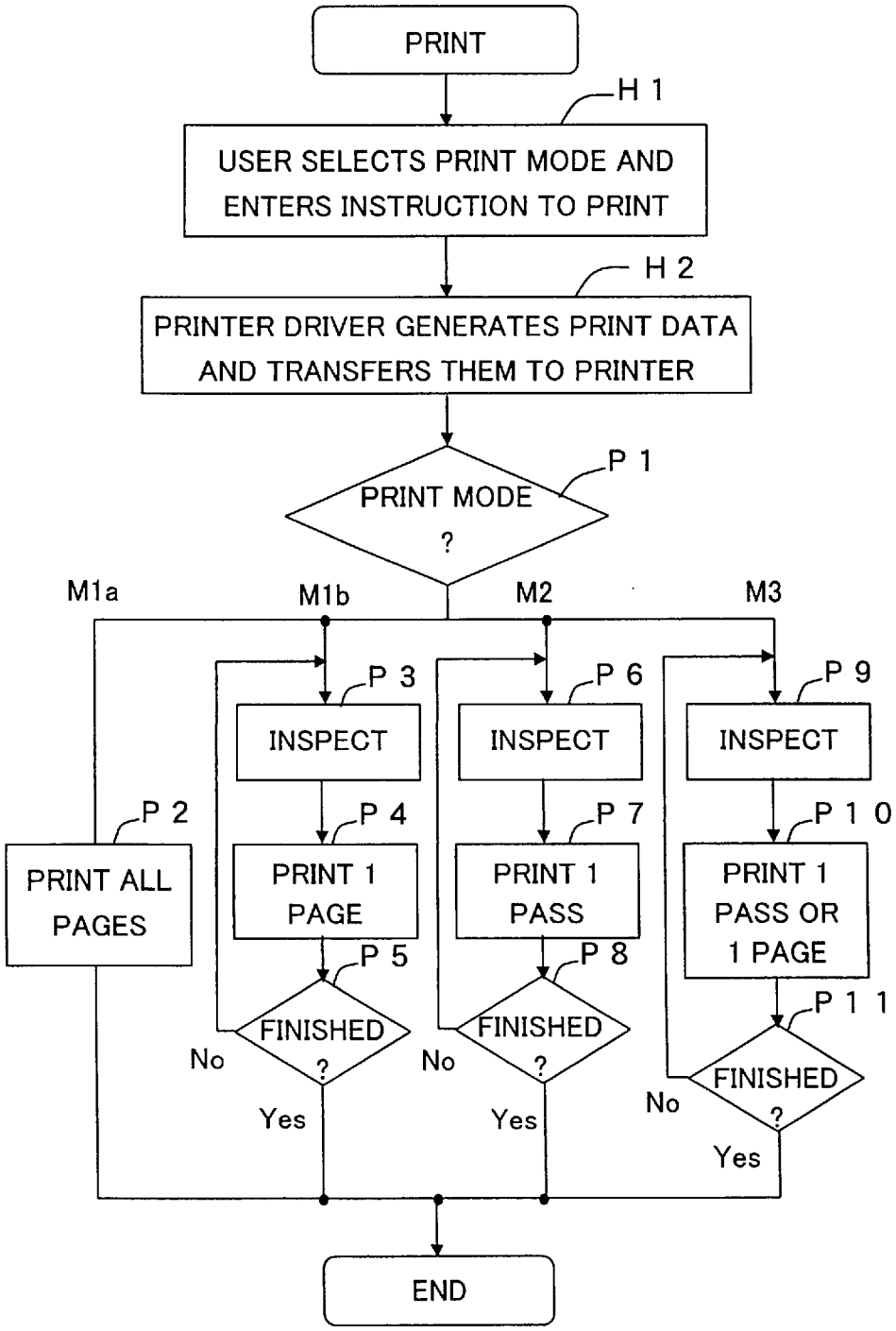
FIG. 9 is a flowchart showing the print processing procedure in an embodiment of the present invention.

FIG. 9 is a flowchart showing the printing operation in Application Example 2 of FIG. 7(B). In step H1, the user selects a print mode and enters an instruction to print, using the screen of the host computer 100. In step H2, the printer driver of the host computer 100 generates print data and transfers them to the printer 20. The header of the print data includes print mode information for discriminating the print mode. The print mode information includes various data such as the print resolution, the number of used nozzles N, the scan repetition number s, and the sub-scan feed amount. In this description, "printing operation" means the total of all processing operations automatically conducted by the host computer 100 and the printer 20 after the user's instruction. In this sense, all processing operations from step H2 onward correspond to the "printing operation."

Steps P1–P11 are printing operation steps automatically performed by the printer 20. In step P1, the system controller 54 (FIG. 2) discriminates the print mode to be utilized by reading the print mode information recorded in the header of the print data transferred from the receiving buffer memory 50. In step P2 and the following steps, dot dropout inspection is conducted at the inspection timing and by the inspection method shown in FIG. 7(B) for the print mode, and printing is also performed. In the case of the first draft mode M1*a*, for example, all pages are printed without conducting any dot dropout inspection whatsoever (step P2). In the super-fine mode M3, printing is conducted while conducting dot dropout inspection once every pass and once before printing every page (steps P9–P11) until printing of all pages is completed. In the second draft mode M1*b*, printing is conducted while dot dropout inspection is executed after printing one page (steps P3–P5) and in the fine mode M2 printing is conducted while dot dropout inspection is executed after each pass (steps P6–P8).

Thus, the foregoing embodiments determine a different combination of a dot dropout inspection timing and an inspection method for each of the plurality of print modes usable by the printer 20. Dot dropout inspection suitable for the print mode can therefore be conducted. A plurality of modes differing from each other in at least one of raster line recording speed (i.e., effective nozzle number N/s) and print resolution can be adapted as the plurality of print modes usable by the printer 20.

Focusing solely on inspection timing, in Application Example 1 of FIG. 7(A), the draft mode M1 and the super-fine mode M3 use the same inspection timing of "before printing each page," while the fine mode M2 uses the inspection timing of "every pass."Thus, in this way, it is adequate to set different dot dropout inspection timings during printing operations with respect to at least two print modes among a plurality of print modes usable by the printer.

In Application Example 2, the flying droplet inspection method is used for the inspection before printing each page in the draft mode M1*b* and the color patch inspection method is used for the inspection before printing each page in the super-fine mode M3. Thus, even when the same inspection timing is adopted, an inspection most suitable for the print mode can be conducted by adopting an inspection method (inspection principle) suitable for the factor (printing time or image quality) aimed at by the used print mode.

It is also possible to use different inspection methods for inspections conducted at different timings. Consider, for example, the case in which the ordinary draft mode M1*b* is omitted from Application Example 2. This would result in the color patch inspection method being used for inspection before printing each page and the flying droplet inspection method being used for inspection at every pass. This enables use of the preferable inspection method suitable for the inspection timing.

This invention is in no way limited to the embodiments and examples described in the foregoing but various modifications may be made without departing from the scope of the appended claims. For example, at least the following modifications (1)–(5) are possible.

(1) In the foregoing embodiments, some constituent elements implemented by hardware circuitry can be replaced by software and some constituent elements implemented by software can be replaced by hardware circuitry. A computer program may be provided as recorded on a floppy disk, CD-ROM, or other recording medium and may be stored in a memory (not shown) of the system controller 54. The system controller 54 will then execute the computer program to achieve some of the processing operations of the foregoing embodiment by executing the computer program.

(2) The present invention is generally applicable to printers of the type that jet ink droplets but can be applied to various printers other than color inkjet printers. It can, for example, be applied to facsimile machines and copying machines employing inkjet systems.

(3) The foregoing embodiments utilize only two dot dropout inspection timing modes: before printing each page and at every pass. However, the inspection timing can also be set in various other ways during the printing operation. For example, inspection can be carried out after several printing passes.

(4) The foregoing embodiments were explained with regard to the case in which a single printer is equipped with three dot dropout inspection units 40, 42, and 44. It is adequate, however, for the printer to be equipped with at least one of those dot dropout inspection units.

(5) The foregoing embodiments conduct dot dropout inspection with respect to all nozzles for six colors provided on the print head 36. Instead, however, only the nozzles actually used for the printing operation can be selected for inspection. Various concrete examples, such as the following a)–d), are conceivable.

a) In the case of monochrome printing, it is possible to inspect only the black ink $K_D$ nozzles and omit the other $C_D$, $C_L$, $M_D$, $M_L$, and $Y_D$ color nozzles from inspection.

b) Depending on the print mode, color images are sometimes printed using only the four dark inks $C_D$, $M_D$, $Y_D$ and $K_D$, without using the light inks $C_L$ and $M_L$. In this case, it is possible to inspect only the nozzles for the four dark inks.

c) Some printers are equipped with a print head provided with three rows of nozzles for black ink. Such a printer performs color printing using one row of nozzles among the three rows of nozzles for black ink and the other nozzles for color ink, and performs monochrome printing using all nozzles in the three rows for black ink. When such a printer is used, it is possible in color printing to omit from inspection the nozzles for black ink of the two rows not used for the printing operation.

d) Depending on the print mode, not all the nozzles for each ink are used and only some nozzles for each ink are used. For instance, there are cases in which 48 nozzles are provided for each ink but printing is conducted using only 41 nozzles of each set of 48 nozzles. In such a case, it is possible to omit from inspection the seven nozzles for each ink that are not used (total of 42 nozzles for six colors).

Selectively conducting dot dropout inspection only with respect to the nozzles actually used in the printing operation in the foregoing manner is advantageous in that it shortens the inspection period.

Obviously, numerous additional modifications and variations of the present invention are possible in light of the above teachings. It is therefore to be understood that within the scope of the appended claims, the present invention may be practiced otherwise than as specifically described herein.

What is claimed is:

1. In a printer that prints images by jetting ink droplets from a plurality of nozzles to record dots on a surface of a printing medium, a method of inspecting for a presence/absence of jetting of ink droplets from the nozzles comprising the steps of:

(a) presetting different timings during a printing operation for conducting inspection with respect to at least two print modes among a plurality of print modes, the plurality of print modes differing in at least one of print resolution and raster line recording speed indicative of a net time required to record one raster line; and (b) when printing is performed according to a print mode selected from among the at least two print modes, conducting the inspection at the timing preset with respect to the selected print mode.

2. A method according to claim 1, wherein printing is performed without conducting the inspection in a print mode whose raster line recording speed and print resolution are lowest among the plurality of print modes.

3. A method according to claim 1, wherein only nozzles actually used in the printing operation are selected for targets of the inspection.

4. In a printer that prints images by jetting ink droplets from a plurality of nozzles to record dots on a surface of a printing medium, a method of inspecting for a presence/absence of jetting of ink droplets from the nozzles comprising the steps of:

(a) presetting different combinations of timings for conducting inspection and inspection principles with respect to at least two print modes among a plurality of print modes, the plurality of print modes differing in at least one of print resolution and raster line recording speed indicative of a net time required to record one raster line; and (b) when printing is performed according to a print mode selected from among the at least two print modes, conducting the inspection in accordance with the timing and inspection principle preset with respect to the selected print mode.

5. A method according to claim 4, wherein printing is performed without conducting the inspection in a print mode whose raster line recording speed and print resolution are lowest among the plurality of print modes.

6. A method according to claim 4, wherein only nozzles actually used in the printing operation are selected for target of the inspection.

7. A printer that prints images by jetting ink droplets from a plurality of nozzles to record dots on a surface of a printing medium, comprising:

a controller configured to preset different preset timings during a printing operation, as timings for conducting an inspection for a presence/absence of jetting of ink droplets from the nozzles, with respect to at least two print modes among a plurality of print modes, the plurality of print modes differing in at least one of print resolution and raster line recording speed indicative of net time required to record one raster line; and wherein when printing is performed according to a print mode selected from among the at least two print modes, the controller controls the printer to conduct the inspection at the timing preset with respect to the selected print mode.

8. A printer according to claim 7, wherein the printer performs printing without conducting the inspection in a print mode whose raster line recording speed and print resolution are lowest among the plurality of print modes.

9. A printer according to claim 7, wherein only nozzles actually used in the printing operation are selected for targets of the inspection.

10. A printer that prints images by jetting ink droplets from a plurality of nozzles to record dots on a surface of a printing medium, comprising:

a controller configured to preset different preset combinations of timings for conducting an inspection for a presence/absence of jetting of ink droplets from the nozzles and inspection principles, with respect to at least two print modes among a plurality of print modes, the plurality of print modes differing in at least one of print resolution and raster line recording speed indicative of net time required to record one raster line; and wherein when printing is performed according to a print mode selected from among the at least two print modes, the controller controls the printer to conduct the inspection in accordance with the timing and inspection principle preset with respect to the selected print mode.

11. A printer according to claim 10, wherein the printer performs printing without conducting the inspection in a print mode whose raster line recording speed and print resolution are lowest among the plurality of print modes.

12. A printer according to claim 10, wherein only nozzles actually used in the printing operation are selected for target of the inspection.

13. A computer readable medium storing a computer program for causing a computer including a printer to inspect for a presence/absence of jetting of ink droplets from nozzles, the printer printing images by jetting ink droplets from a plurality of nozzles to record dots on a surface of a printing medium, the computer program causing the computer to implement the function of:

presetting different timings during a printing operation for conducting inspection with respect to at least two print modes among a plurality of print modes, the plurality of print modes differing in at least one of print resolution and raster line recording speed indicative of a net time required to record one raster line; and when printing is performed according to a print mode selected from among the at least two print modes, conducting the inspection at the timing preset with respect to the selected print mode.

14. A computer readable medium according to claim 13, wherein the computer program causes the computer to implement the further function of performing the printing without conducting the inspection in a print mode whose raster line recording speed and print resolution are lowest among the plurality of print modes.

15. A computer readable medium according to claim 13, wherein the computer program causes the computer to implement the further function of selecting only nozzles actually used in the printing operation for targets of the inspection.

16. A computer readable medium storing a computer program for causing a computer including a printer to inspect for a presence/absence of jetting of ink droplets from nozzles, the printer printing images by jetting ink droplets from a plurality of nozzles to record dots on a surface of a printing medium, the computer program causing the computer to implement the function of:

presetting a different combination of timings for conducting inspection and inspection principles with respect to at least two print modes among a plurality of print modes, the plurality of print modes differing in at least one of print resolution and raster line recording speed indicative of net time required to record one raster line; and when printing is performed according to a print mode selected from among the at least two print modes, conducting the inspection in accordance with the timing and inspection principle preset with respect to the selected print mode.

17. A computer readable medium according to claim 16, wherein the computer program causes the computer to implement the further function of performing the printing without conducting the inspection in a print mode whose raster line recording speed and print resolution are lowest among the plurality of print modes.

18. A computer readable medium according to claim 16, wherein the computer program causes the computer to implement the further function of selecting only nozzles actually used in the printing operation for targets of the inspection.

* * * * *

UNITED STATES PATENT AND TRADEMARK OFFICE

CERTIFICATE OF CORRECTION

PATENT NO. : 6,454,380 B1
DATED : September 24, 2002
INVENTOR(S) : Endo

It is certified that error appears in the above-identified patent and that said Letters Patent is hereby corrected as shown below:

Title page, Item [54] and Column 1, lines 1-3,
The Title should read:

-- [54] DOT DROPOUT INSPECTION METHOD AND PRINTER, AND RECORDING MEDIUM STORING PROGRAM THEREFOR --

Signed and Sealed this

Thirty-first Day of December, 2002

JAMES E. ROGAN
*Director of the United States Patent and Trademark Office*